US005692599A

United States Patent [19]

Winter

[11] Patent Number: 5,692,599

[45] Date of Patent: Dec. 2, 1997

[54] TOGGLE SPRING FOR A CIRCUIT BREAKER

[75] Inventor: John M. Winter, Cedar Rapids, Iowa

[73] Assignee: Square D Company, Palatine, Ill.

[21] Appl. No.: 584,446

[22] Filed: Jan. 10, 1996

[51] Int. Cl.[6] ..... H01H 3/54

[52] U.S. Cl. ..... 200/401; 24/698.3; 267/179

[58] Field of Search ..... 200/401; 267/170, 267/179, 166, 70, 73; 24/698.3

[56] References Cited

U.S. PATENT DOCUMENTS

| | | | |
|---|---|---|---|
| 2,013,595 | 9/1935 | Barnard | 267/179 X |
| 2,051,670 | 8/1936 | Anton | 267/179 X |
| 4,129,762 | 12/1978 | Bruchet | 200/401 |

*Primary Examiner*—Renee S. Luebke

*Attorney, Agent, or Firm*—Kareem M. Irfan; Wayne Stoppelmoor; Larry I. Golden

[57] ABSTRACT

A toggle spring for a circuit breaker operating mechanism which provides better performance and reliability is provided. The toggle spring includes a unique spring eye having a back hook portion extending around a spring shank so as to dramatically increase the force supportable by the spring eye. The toggle spring is provided having a body portion having a first end and a second end. A first spring eye extends from the first end of the body portion and a shank extends from the second end of the body portion. A second spring eye extends from the shank and includes the back hook portion which extends around the shank.

10 Claims, 5 Drawing Sheets

TOGGLE SPRING FOR A CIRCUIT BREAKER

FIELD OF THE INVENTION

This invention relates generally to circuit breakers, and more particularly, to a toggle spring for a circuit breaker which provides improvements in terms of durability and reliability.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable blade which rotates away from a stationary contact in order to interrupt the current path. In response to an overcurrent condition, circuit breakers generally move the blade to break the current path by tripping a spring-biased operating mechanism which forces the blade and its contact away from the fixed contact. Typically, a spring having a spring eye at both of its ends is attached between a handle or a handle arm and a toggle pin to provide the spring-biasing forces. A drawback of some existing toggle springs is that their spring eyes may fracture due to the forces required to operate the operating mechanism.

Accordingly, there is a distinct need to provide an improved circuit breaker operating mechanism which uses a toggle spring designed for reduced operating stress, increased strength and extended life.

SUMMARY OF THE INVENTION

The present invention provides a toggle spring for a circuit breaker which will have reduced operating stress, increased strength and extended life.

The toggle spring of this invention includes a unique spring eye having a back hook portion extending around the spring shank so as to dramatically increase the force supportable by the spring eye. In accordance with a preferred embodiment of the present invention a toggle spring for a circuit breaker operating mechanism includes a body portion with a first end and a second end. A first spring eye extends from the first end of the body portion and a shank extends from the second end of the body portion. A second spring eye extends from the shank and includes the back hook portion which extends around the shank.

BRIEF DESCRIPTION OF THE DRAWINGS

Other objects and advantages of the invention will be apparent from the following detailed description and the accompanying drawings in which.

Figure 1:
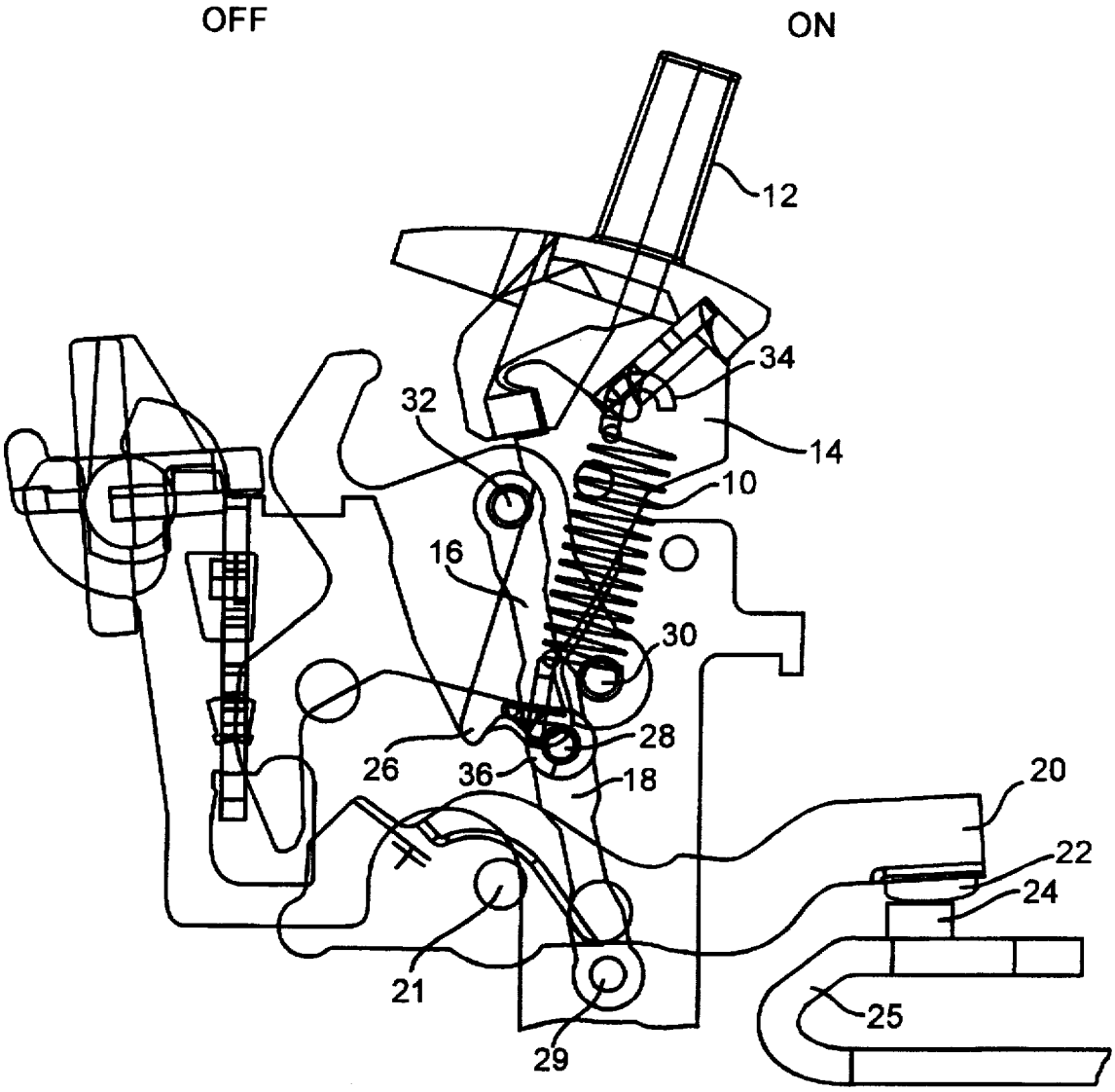
FIG. 1 illustrates, in a functional relationship, certain pertinent components of a typical circuit breaker operating mechanism.

While the invention is susceptible to various modifications and alternative forms, a specific embodiment thereof has been shown by way of example in the drawings and will be described in detail. It should be understood, however, that it is not intended to limit the invention to the particular form described, but on the contrary, the invention is to cover all modifications, equivalents, and alternatives falling within the spirit and scope of the invention as defined by the appended claims.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

The present invention is discussed hereinafter in the context of an exemplary circuit breaker, certain pertinent aspects which are shown in FIG. 1, which includes a toggle spring 10 embodying the principles of the present invention. The particular circuit breaker functionally illustrated and briefly described with reference to FIG. 1 is used for illustrative purposes only; there is no intention to limit the scope and possible applications of the present invention, which is adapted for use with a wide variety of circuit breakers. In order to better explain the utility of the present invention the circuit breaker of FIG. 1 will first be briefly described, followed by a detailed description of an illustrative embodiment of the toggle spring 10. A more detailed description of an exemplary circuit breaker is provided in U.S. Pat. No. 5,500,496 entitled "Handle Assembly for a Circuit Breaker" which is assigned to the same assignee as the present invention and the disclosure therein is incorporated herein by reference.

The circuit breaker includes an operating mechanism, handle 12, handle arm 14, blade 20 rotatable about a blade pivot pin 21, movable contact 22, stationary contact 24 and line terminal 25. The operating mechanism includes the toggle spring 10, upper link 14 and lower link 18. The handle 12 is attached to the handle arm 14 which rotates about a handle arm pivot 26. The toggle spring 10 has a first loop or spring eye 34 extending from one end and a second loop or spring eye 36 extending from its other end. The first spring eye 34 is coupled to the handle arm 14. The second spring eye 36, a lower end of the upper link 16 and an upper end of the lower link 18 are rotatably coupled to a toggle pin 28. A lower end of the lower link 18 rotates about a blade drive pin 29 in a blade cross bar (not shown) and is rotatably coupled to the blade 20 through the blade cross bar (not shown). The movable contact 22 is attached to the blade 20 and engages the stationary contact 24, which is attached to the line terminal 25, when the circuit breaker is in an ON operating mode which corresponds to an ON electrical condition. The movable contact 22 and the stationary contact 24 are separated from each other when the circuit breaker is in an OFF operating mode which corresponds to an OFF electrical condition.

Figure 6:
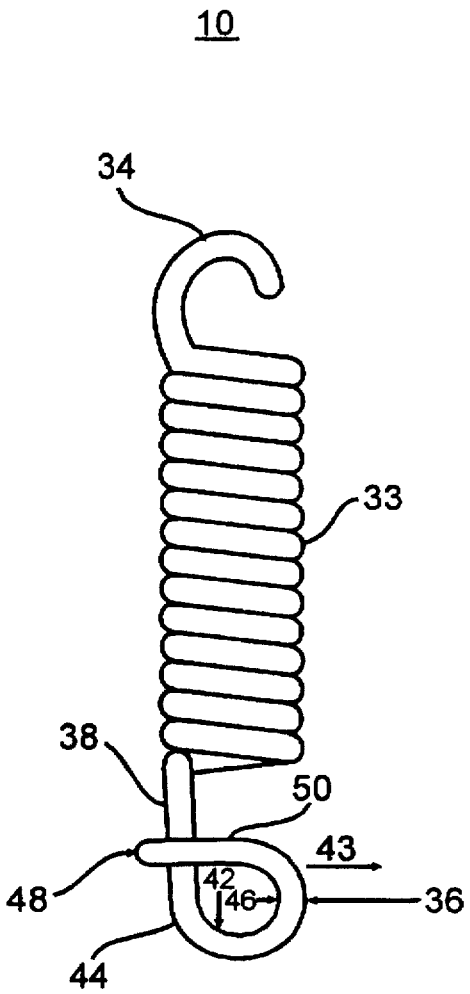
FIG. 6 is a front view of the toggle spring shown in FIG. 4.
Figure 7:
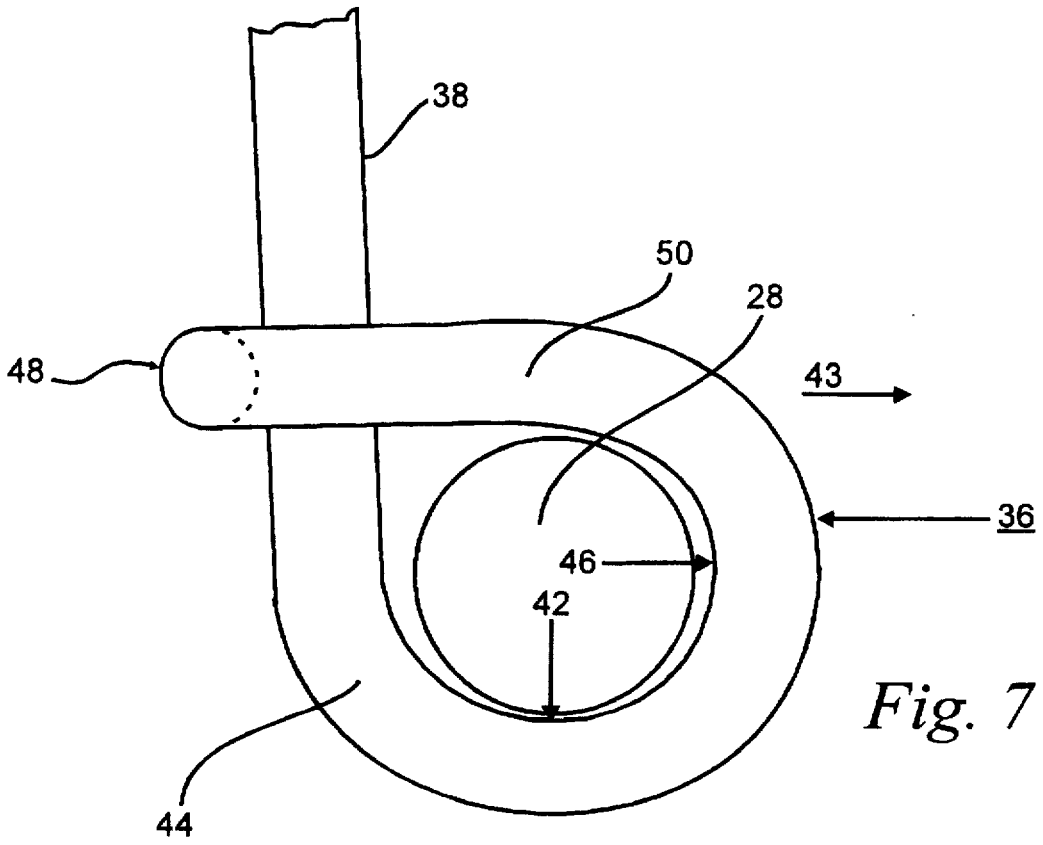
FIG. 7 is a front view of a spring eye of the toggle spring shown in FIG. 4.
Figure 8:
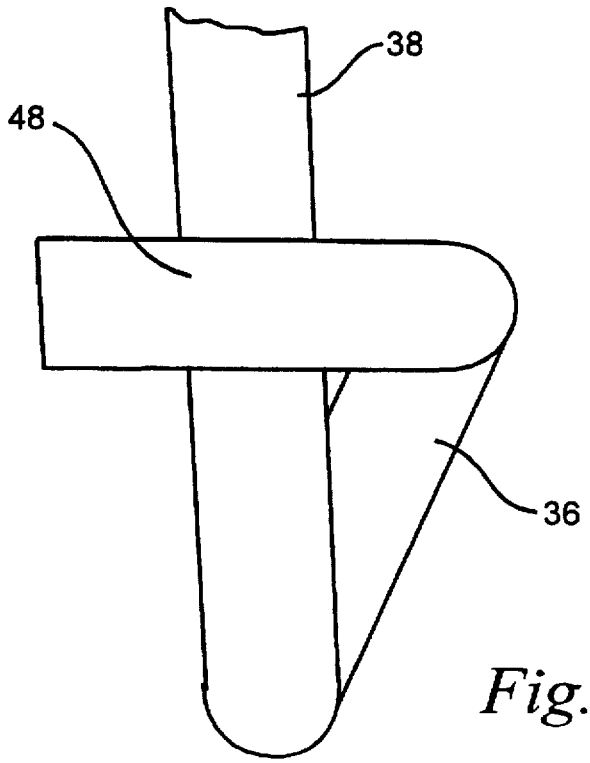
FIG. 8 is a side view of the spring eye shown in FIG. 6.

The handle arm 14 and the first end of the toggle spring 10 rotate about the handle arm pivot 26 when the handle 12 is moved between ON and OFF positions. This movement of the handle 12 causes to toggle spring 10 to pull the toggle pin thereby stretching the toggle spring 10 between the handle arm 14 and the toggle pin 28 thereby creating a stretching force (represented by arrow 42 in FIGS. 3, 6 and 7 as acted on the second spring eye by the toggle pin 28).

FIG. 1 shows the circuit breaker in the ON operating mode. The circuit breaker is placed in the OFF operating mode by rotating the handle 12 and the handle arm 14 counterclockwise to the OFF position. The OFF position is the farthest point the handle arm 14 can be rotated counterclockwise. As the handle arm 14 rotates counterclockwise, the toggle spring 10 pulls the toggle pin 28 backward causing the upper and lower links 16, 18 to collapse. More specifically, as the handle arm 14 rotates counterclockwise, the toggle pin 28 is pulled backward causing the upper link 16 to rotate clockwise about an upper link pin 32. The backward movement of the toggle pin 28 forces the lower link 18 to rotate counterclockwise about the blade drive pin 29 causing the blade cross bar (not shown) to rotate thereby causing the blade 20 to rotate counterclockwise; hence, separating the contacts 22, 24.

The circuit breaker is placed in the ON operating mode by rotating the handle 12 and the handle arm 14 clockwise to the ON position. The ON position is the farthest point the handle arm 14 can be rotated clockwise. As the handle arm 14 rotates clockwise, the toggle spring 10 pulls the toggle pin 28 forward to force the upper and lower links 16, 18 to rotate into alignment. The forward movement of the toggle pin 28, upper link 16 and lower link 18 is stopped suddenly when they engage a cradle stop pin 30. This sudden engagement between the upper and lower links 16, 18 and the cradle stop pin 30 prevents them from rotating beyond the aligned position; however, it generates a shock force (represented by force arrow 46 in FIGS. 3, 6 and 7) on the second spring eye. The movement of the upper and lower links 16, 18 forces the blade 20 to rotate clockwise about the blade pivot pin 21 thereby moving the movable contact 22 into engagement with the stationary contact 24.

Figure 2:
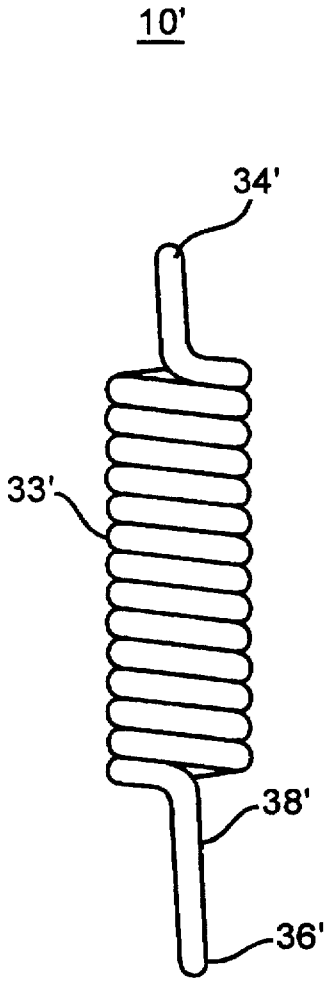
PRIOR ART Fig. 2
FIG. 2 a side view of a prior art toggle spring.
Figure 3:
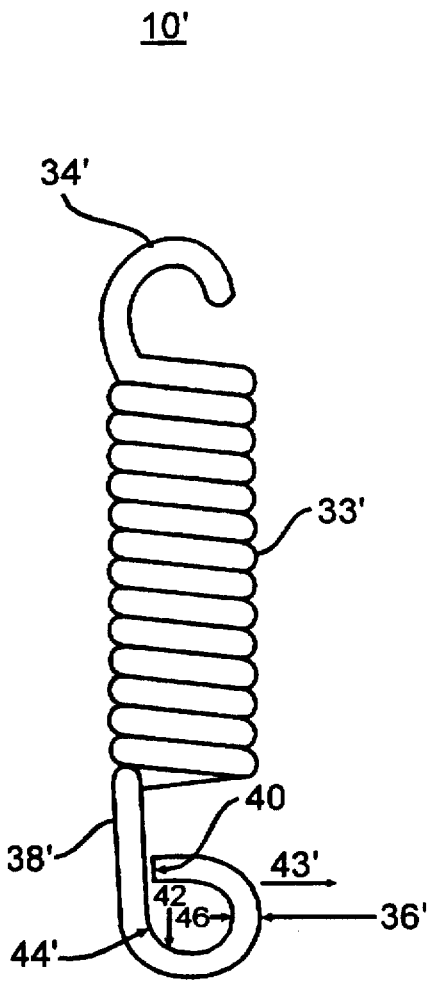
PRIOR ART Fig. 3
FIG. 3 is a front view of the prior an toggle spring shown in FIG. 2.
Figure 4:
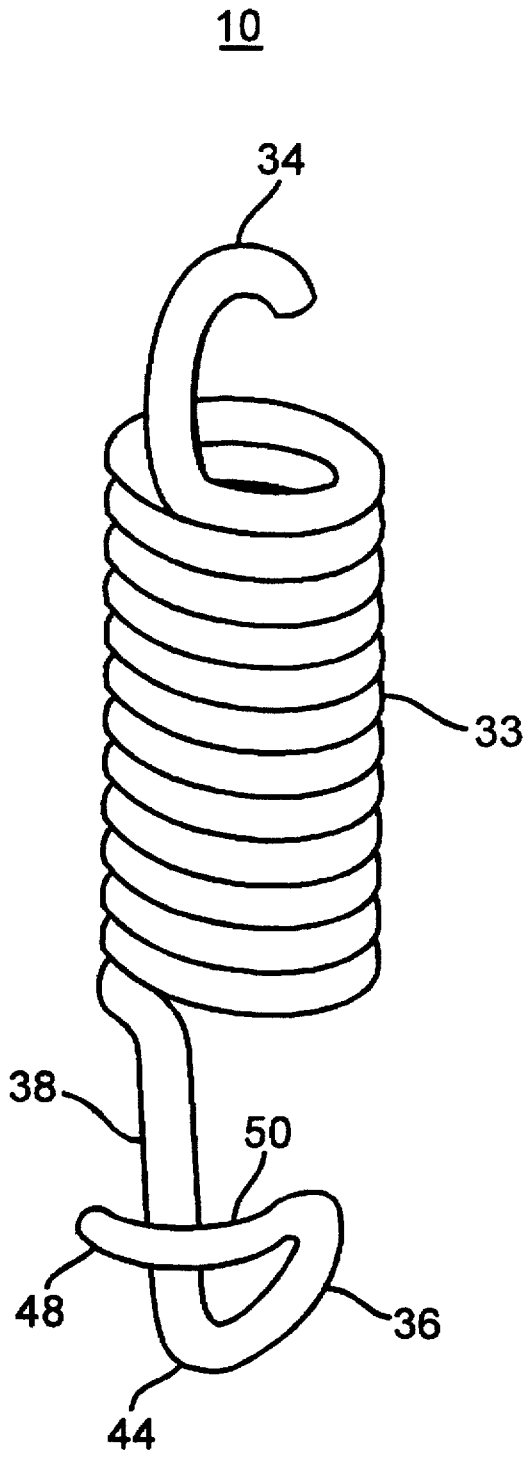
FIG. 4 is an isometric view of a toggle spring, according to a preferred embodiment of the present invention.
Figure 5:
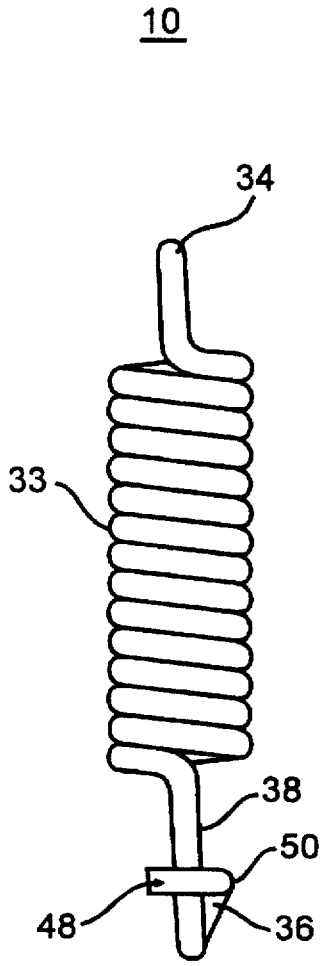
FIG. 5 is a side view of the toggle spring shown in FIG. 4.

FIGS. 2 and 3 show a prior art toggle spring 10' of the type commonly used thusfar in circuit breaker applications. The prior art toggle spring 10' is made of a wire material having a certain maximum tensile strength and includes a helically shaped or coiled body portion 33', a first spring eye 34' extending from a first end and a second spring eye 36' extending from a shank 38' at its second end. The second spring eye 36' has a conventional end 40 that curls towards the shank 38' but does not extend past the shank 38'. The first spring eye 34' is adapted to be connected to the handle arm 14 (FIG. 1) and the second spring eye 36' is adapted to be coupled to the toggle pin 28 (FIG. 1 ).

When the prior art toggle spring 10' is implemented in circuit breaker applications, the stretching force 42 and the shock force 46 act upon the second spring eye 36' similar to the way they act on the second spring eye 36 of the toggle spring 10. A drawback to the prior art toggle spring 10' is that stress on the second spring eye 36' caused by the stretching force 42 combined with the shock force 46 cause the prior art toggle spring 10' to prematurely break. The stretching force 42 and the shock force 46 cause the second spring eye 36' to open outwardly, in the direction of direction arrow 43', which generates stress on the second spring eye 36' at a stress point 44'. The prior art toggle spring 10' does not provide support to the second spring eye 36' to compensate for the stress at the stress point 44'. Each ON/OFF cycle of the circuit breaker causes the stress point 44' to endure a stress which exceeds the maximum tensile strength, of the wire material, which eventually weakens the stress point 44' to a point where the second spring eye 36' breaks at the stress point 44'. Therefore, the number of OFF/ON operations that the prior art toggle spring 10' can perform is reduced due to the breakage of the prior art toggle spring 10'.

FIGS. 4–8 show the preferred embodiment of the toggle spring 10 of the present invention, which solves the problems of the spring eye breakage in the prior art, without changing the characteristics of the toggle spring, by means of a unique, yet uncomplicated, spring eye structure that dramatically reduces the stress to which it is subjected to during circuit breaker ON/OFF operations and consequently increases spring life significantly. In particular, the toggle spring 10 is made of a wire material having a certain maximum tensile strength and includes a helically shaped or coiled body portion 33 having the first spring eye 34 extending from one end thereof and the second spring eye 36 extending from a shank 38 which extends from the opposite end of the body portion 33. The second spring eye 36 includes a back hook portion 48 extending from a leg portion 50 at a generally right angle thereto and generally perpendicular to the shank 38. The back hook portion 48 is disposed adjacent to and extends past the shank 38 and wraps partially around the shank 38. The first spring eye 34 is adapted to be connected to the handle arm 14 (FIG. 1) and the second spring eye 36 is adapted to be coupled to the toggle pin 28 (FIG. 1 ).

When the toggle spring 10 is implemented in circuit breaker applications, the stretching force 42 and the shock force 46 act upon the second spring eye 36 at a stress point 44, which is disposed at the same location on the toggle spring 10 as the stress point 44' is located on the prior art toggle spring 10'. An advantage of the toggle spring 10 of the present invention is that the back hook portion 48 dramatically reduces the stress that must be endured by the stress point 44, as compared to the stress that must be endured at the stress point 44' of the prior art toggle spring 10'. When the stretching force 42 and the shock force 46 act upon the second spring eye 36, the second spring eye 36 is prevented from opening outwardly in the direction of direction arrow 43 (FIG. 6), as would occur with the prior art spring eye 36', because the back hook portion 48 engages the shank 38, thereby distributing a portion of the stress from the stress point 44 to the shank 38 rather than all of the stress being concentrated at the stress point 44. This distribution of the stress limits the stress that the stress point 44 must endure to a value below the tensile strength of the wire material. With the reduction of stress at the stress point 44, the amount of force supported by the second spring eye 36 is increased dramatically and the number of circuit breaker OFF/ON operations is increased many times.

From the foregoing detailed description, it can thus be seen that the present invention provides a toggle spring which has an increased life cycle thereby providing reliability and endurance to the circuit breaker in which it is utilized.

What is claimed is:

1. A spring for a circuit breaker comprising:

a body portion having a first end and a second end;

a first spring eye extending from said first end of said body portion;

a shank extending from said second end of said body portion; and a second spring eye extending from said shank, said second spring eye having a back hook portion which extends around said shank.

2. A spring for a circuit breaker comprising:

a helically shaped body portion having a first end and a second end;

a first spring eye extending from said first end of said body portion;

a generally straight shank extending axially from said second end of said body portion;

a second spring eye extending from said shank said second spring eye having a stress point where stress is generated as a result of said second spring eye opening outwardly; and distributing means for distributing stress from said stress point to said shank.

3. A spring according to claim 2, wherein said distributing means includes a hook portion extending from said second spring eye and around said shank.

4. A spring according to claim 2, wherein said distributing means includes a hook portion extending from said second spring eye generally perpendicular to said shank and engaging said shank.

5. An expansion spring for a circuit breaker comprising:

a helically coiled body portion having a plurality of coils, said body portion having a hook shaped portion extending from one end and a generally straight shank extending generally axially from an opposite end;

a loop extending from said shank, said loop having a leg portion which extends past said shank; and a second hook portion extending from said leg portion at a generally right angle to said leg portion and generally perpendicular to said shank, said hook portion engaging said shank thereby providing support to said loop.

6. A circuit breaker comprising:

a stationary contact;

a movable contact;

a blade carrying said movable contact and movable between (i) a first position wherein said movable contact is engaged with said stationary contact and corresponding to an ON electrical circuit condition and (ii) a second position wherein said movable contact is spaced away from said stationary contact and corresponding to an OFF electrical condition;

an operating means for moving said blade from said first position to said second position;

a handle for initiating said operating means movable between said ON electrical condition and said OFF electrical condition;

a spring having a coiled body portion, a first end coupled to said handle, a shank extending from said body and a second end extending from said shank which is coupled to said operating means, said spring being stretched between said handle and said operating means when said handle is moved between said ON position and said OFF position thereby creating a stress that acts upon a stress point on said second end of said spring; and stress distribution means disposed on said second end of said spring for distributing said stress on said stress point to said shank, said stress distribution means including a hook portion extending from said second end and partially wrapping around said shank.

7. A circuit breaker according to claim 6, said spring comprising a wire material having a predetermined maximum tensile strength.

8. A circuit breaker according to claim 7, wherein said stress distribution means prevents said stress from developing to a value which is greater than said predetermined maximum tensile strength.

9. A circuit breaker comprising:

a stationary contact;

a movable contact;

a blade carrying said movable contact and movable between (i) a first position wherein said movable contact is engaged with said stationary contact and corresponding to an ON electrical circuit condition and (ii) a second position wherein said movable contact is spaced away from said stationary contact and corresponding to an OFF electrical condition;

an operating mechanism for moving said blade from said first position to said second position;

a handle for initiating said operating means movable between said ON electrical condition and said OFF electrical condition; and a spring including:

a coiled body portion having a plurality of coils, said body portion having a hook shaped portion extending from one end and a generally straight shank extending generally axially from an opposite end, said hook shaped portion adapted to be coupled to said handle;

a loop extending from said shank and coupled to said operating means, said loop having a stress point; and distributing means for distributing stress from said stress point to said shank, wherein said distributing means includes:

a leg portion extending past said shank; and a back hook portion extending from said leg portion at a generally right angle to said leg portion and generally perpendicular to said shank, said hook portion engaging said shank thereby preventing said loop from expanding outwardly when forces are applied to said loop.

10. A circuit breaker according to claim 9, wherein said distributing means prevents stress which is generated at said stress point from developing to a value which is greater that a predetermined maximum strength of said loop.

* * * * *